US006413326B1

(12) United States Patent
Rallis

(10) Patent No.: US 6,413,326 B1
(45) Date of Patent: Jul. 2, 2002

(54) HIGH STRENGTH COUPLING AND METHOD

(76) Inventor: Anthony T. Rallis, P.O. Box 3061, Coppell, TX (US) 75019

( * ) Notice: Subject to any disclaimer, the term of this patent is extended or adjusted under 35 U.S.C. 154(b) by 31 days.

(21) Appl. No.: 09/710,224

(22) Filed: Nov. 10, 2000

Related U.S. Application Data

(60) Provisional application No. 60/165,753, filed on Nov. 16, 1999.

(51) Int. Cl.[7] ..... C23C 8/66
(52) U.S. Cl. ..... 148/220; 427/328
(58) Field of Search ..... 148/220; 427/328

(56) References Cited

U.S. PATENT DOCUMENTS 4,655,852 A * 4/1987 Rallis
4,757,861 A 7/1988 Klyne ..... 166/241
4,871,020 A 10/1989 Rivas et al. ..... 166/241
4,905,760 A 3/1990 Gray ..... 166/68
5,196,075 A 3/1993 Jansen et al. ..... 148/530
5,334,268 A 8/1994 Hermanson et al. ..... 148/530
5,405,457 A 4/1995 Hermanson et al. ..... 148/400
5,405,461 A 4/1995 Hermanson et al. ..... 148/530
5,513,972 A * 5/1996 Schroeder et al.

* cited by examiner

*Primary Examiner*—Sikyin Ip
(74) *Attorney, Agent, or Firm*—Stephen A. Slusher

(57) ABSTRACT

A threaded steel coupling with an exterior coating and interior case and threads, wherein the coupling body consists primarily of bainite and the interior case and threads consist primarily of a mixture of martensite and bainite. Also provided is a method of fabrication, including selective carburization of the interior threaded portion of the steel coupling forming the case and austempering.

13 Claims, 1 Drawing Sheet

HIGH STRENGTH COUPLING AND METHOD

CROSS-REFERENCE TO RELATED APPLICATION

This application claims the benefit of the filing of U.S. Provisional patent application Ser. No. 60/165,753, entitled Process of Making High Strength Coupling, filed on Nov. 16, 1999, and the specification thereof is incorporated herein by reference.

BACKGROUND OF THE INVENTION

1. Field of the Invention (Technical Field)

The present invention relates to high strength couplings and methods for making the same, and primarily couplings as for use in connecting casing pipe, tubing and sucker rods in oil and gas wells.

2. Background Art

The various components of oil well casings, tubing and sucker rod strings must often operate under severe corrosive and loading conditions. Presently, couplings used for connecting these components, which are made of carbon or alloy steel, very frequently fail because of corrosion attack, wear or fatigue fracture. In order to minimize failure where corrosion is encountered, a corrosion inhibitor is frequently injected into the well in an effort to provide corrosion protection. But in many wells high operating temperatures render protective inhibitors useless and ineffective.

Another method to overcome corrosion attack is to apply a corrosion and wear resistant metallic coating on the outer surface of the coupling. These coatings are usually applied with thermospraying techniques called metallizing. This process, however, also softens the steel, thereby reducing the strength level and making the coupling more susceptible to fatigue fracture. In order to increase the strength, and in particular, the fatigue resistance in the threaded portion of these couplings, the threads are roll-formed after metallizing is completed, to induce compressive stresses in the thread roots, thus increasing the fatigue life of the coupling. If the coupling is roll-threaded before the metallizing process, the compressive stresses are tempered back during the subsequent metallizing process, reducing the fatigue resistance in the threaded roots where fatigue fracture very often initiates. Therefore, in order to permanently induce compressive stresses in the thread roots, roll-threading is employed only after metallizing or heat treating is completed. Although roll-threading helps greatly in increasing the fatigue life in the coupling, it is a costly process, making the couplings more expensive because of the additional power required to roll-thread compared to that required by machine cutting the threads. In couplings used presently for sucker rod strings, however, the roll-threading process is relatively inexpensive, because the coupling hardness level is still soft enough, about 20 Rockwall "C" (HRC), to roll-thread with a reasonable amount of power and tool life. If, however, the coupling strength is increased by heat treating, say above about 23 HRC, then the roll-threading process becomes very costly because of the greater turning power and number of roll-forming tools required for roll-threading. This is one reason higher strength couplings have not been developed beyond a strength level of about 23 HRC.

There are a number of prior art methods that address aspects of this problem. Thus U.S. Pat. No. 5,196,075, to Jansen et al., teaches a method of producing a hard corrosion resistant metallic coating on fasteners and screws whereby the nickel or cobalt coating is heated above 850° C. so as to diffuse into the steel matrix. However, high core or fatigue strength is not maintained in this invention. U.S. Pat. No. 4,905,760 to Gray teaches a method of applying a plastic coating on the sucker rod coupling outer surface in order to prevent corrosion of the steel underneath it. Again, neither high core hardness nor fatigue strength is thereby maintained. U.S. Pat. No. 4,871,020, to Rivas et al., teaches a method of incorporating roller bearings on the outside of very elongated sucker rod couplings in order to minimize friction and coupling wear. This does not, however, address the inherent core or fatigue strength of the coupling. In other approaches, such as that disclosed in U.S. Pat. No. 4,757,861, to Klyne, a non-metallic sleeve centralizer is connected between sucker rod couplings.

A series of patents to Hermanson et al., including U.S. Pat. Nos. 5,334,268, 5,405,457, and 5,405,461, (hereafter "Hermanson et al.") teach a method of making a high strength coupling wherein the coupling is heat treated to a hardness between 32 and 36 HRC. In this step, the coupling is heated and quenched in a salt bath maintained at a temperature below the martensite start (MS) temperature. This heat treatment, commonly called "Martempering" or "Marquenching", results in transformation of the steel microstructure to essentially martensite, a hard, brittle, body-centered tetragonal structure. The coupling threads are partially completed by machine cutting and subsequently finished by roll-threading. The partial roll-threading induces very shallow compression stresses, about 0.003 inch deep, into the thread root.

In can thus be appreciated that there is a need for a coupling and method for making the same which possesses exceptional performance characteristics in corrosive environments together with very high resistance to fatigue fracture at a more reduced cost than is presently available.

SUMMARY OF THE INVENTION (DISCLOSURE OF THE INVENTION)

The invention provides a threaded coupling, which is a cylindrical steel core having an inner surface case with a plurality of threads thereon and an outer surface, the outer surface including a metallic coating, where the interior of the steel core wall has a microstructure consisting primarily of bainite, and the inner surface case with a plurality of threads has a microstructure consisting primarily of a mixture of martensite and bainite. In this threaded coupling, the interior of the core well may have a Rockwell hardness of at least about 25 HRC and the inner surface case with a plurality of threads may have a Rockwell hardness of at least about 30 HRC. In one embodiment, the interior of the core well has a Rockwell hardness of at least about 30 HRC and the inner surface case with a plurality of threads has a Rockwell hardness of at least about 33 HRC.

In the threaded coupling, the steel includes carbon and iron, and optionally manganese, nickel, chromium, molybdenum, silicon or boron. The metallic coating of the coupling can include a corrosion and wear resistant metallic coating. This corrosion and wear resistant metallic coating can be made from carbon, iron, nickel, chromium, molybdenum, cobalt, tungsten, silicon, boron, aluminum or a combination thereof.

The invention also provides a method of making a corrosion resistant threaded steel coupling with high fatigue strength, which method includes the steps of providing a cylindrical steel coupling of defined wall thickness having an inner surface and an outer surface; coating the outer surface with a corrosion and wear resistant metallic coating; threading the inner surface to finished dimension with a plurality of threads; carburizing the cylindrical steel coupling, whereby the carbon content of the threaded inner surface is increased; and heat treating the cylindrical steel coupling by austempering, whereby the hardness of the threaded inner surface is increased. In this method, after heat treating the interior of the wall thickness of the cylindrical steel coupling has a microstructure consisting primarily of bainite, and the threaded inner surface has a microstructure consisting primarily of a mixture of martensite and bainite.

In one embodiment of this method, the interior of the wall thickness of the cylindrical steel coupling has a Rockwell hardness of at least about 25 HRC and the threaded inner surface has a Rockwell hardness of at least about 30 HRC, and preferably the interior of the wall thickness of the cylindrical steel coupling has a Rockwell hardness of at least about 30 HRC and the threaded inner surface has a Rockwell hardness of at least about 33 HRC.

The steel of the steel coupling includes carbon and iron, and optionally one or more of manganese, nickel, chromium, molybdenum, silicon or boron. The corrosion resistant metallic coating can be made of carbon, iron, nickel, chromium, molybdenum, cobalt, tungsten, silicon, boron, aluminum, or a combination thereof. The method of coating can include thermospraying, fusing, diffusing, electroplating, vapor deposition or welding. The method of carburizing can include heating above about 1400° F. for at least about thirty minutes in an atmosphere with a carbon potential of at least about 0.35%, and preferably with a carbon potential of at least about 0.60%.

In this method, heat treating by austempering includes heating to an austenitic transformation temperature for at least about thirty minutes, rapidly cooling into a salt bath maintained at a temperature above the martensite start temperature but below the pearlite formation temperature, maintaining in the salt bath for at least about two minutes, and cooling to room temperature. In another embodiment, heat treating by austempering includes maintaining in the salt bath for at least about four minutes. The treating by austempering process can further include subsequent reheating to a temperature of at least about 200° F. for at least about five minutes to temper the microstructure following cooling to room temperature.

Accordingly, a primary object of the present invention is to provide a process by which couplings made of carbon or alloy steels with optimized alloying compositions can be carburized and heat treated by austempering to increase the overall strength of the core while simultaneously or subsequently increasing for fatigue strength of the threads.

Another object of the present invention is to provide a process for making couplings from carbon or alloy steels that can withstand high load stresses and corrosive fluids in a superior manner.

A further object of this invention is to provide a process for making couplings, including downhole couplings such as sucker rod couplings, wherein the coupling is coated with one or more wear and corrosion resistant materials, threaded by machining, carburized and austempered, to form a corrosion resistant high strength coupling.

Another object of the present invention is to provide a method of manufacturing a coupling to provide enhanced corrosion protection, by metallizing the outer surface with corrosion resistant alloys, thereby forming a coupling which resists abrasive wear and corrosive fluids, which coupling is carburized and austempered subsequent to metallization.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing, which is incorporated into and forms a part of the specification, illustrate an embodiment of the present invention and, together with the description, serve to explain the principles of the invention. The drawing is only for the purpose of illustrating a preferred embodiment of the invention and is not to be construed as limiting the invention. In the drawing.

Figure 1:
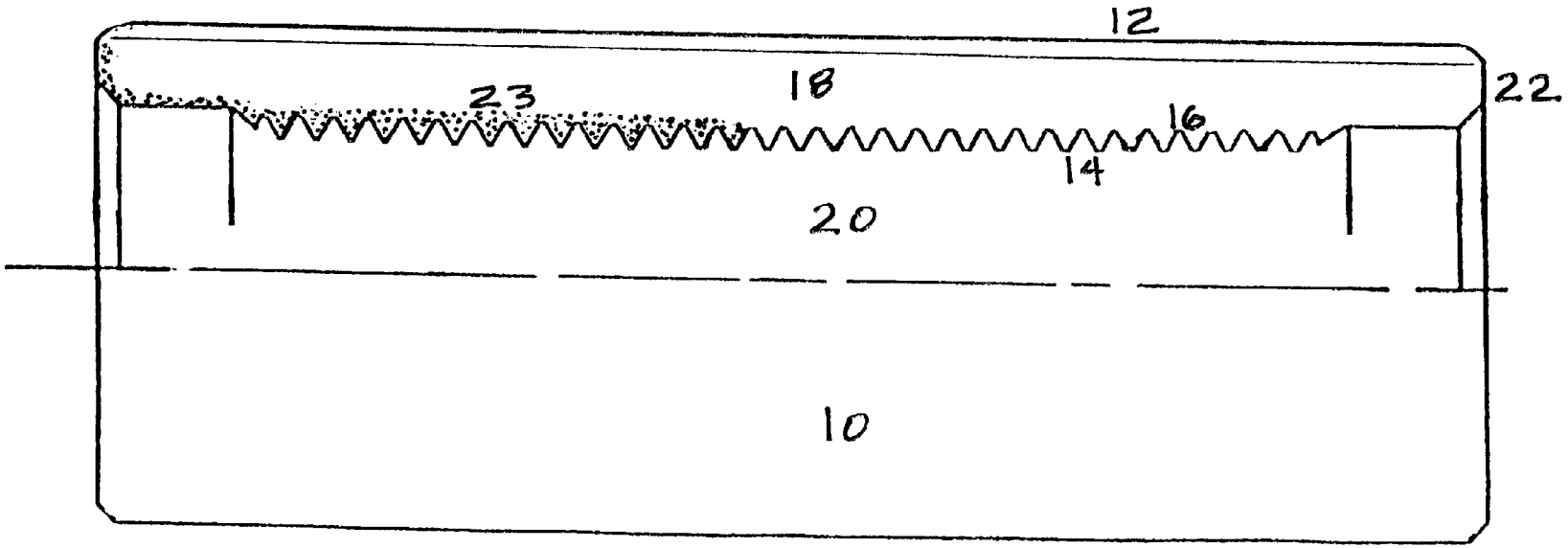
FIG. 1 depicts a coupling of the invention.

DESCRIPTION OF THE PREFERRED EMBODIMENTS (BEST MODES FOR CARRYING OUT THE INVENTION)

In one embodiment, this invention provides a coupling and process of making a coupling for use in oil and gas production wells, in which a combination of metallurgical processes are coordinated so as to make an inexpensive steel coupling with a tough, high-strength core body and a corrosion and wear resistant coating, together with hard inner threads with very high fatigue strength.

In FIG. 1 a high strength coupling 10 of this invention is disclosed. A corrosion and wear resistant metallic coating 12 is applied to the outer surface of coupling 10. The coupling 10, which is a cylindrical steel core, has a defined thickness and an interior 18 of the core body. Within the cavity 20 of the coupling 10 is the interior surface. The interior surface comprises carburized case 23 and is threaded, with thread 14 and thread root 16 depicted. The pitch and interior diameter is standardized as appropriate for the intended purpose. The coupling includes end surfaces 22.

By means of this invention, a coupling 10 is made of a suitable steel or steel alloy, such as AISI 4130 steel tubing, wherein coating 12, such as a layer of nickel-based, corrosion resistant alloy, is applied to the outer surface, the inner surface 20 is machine threaded, and the coupling is subsequently carburized to increase the carbon content of the thread subsurface above that of the base carbon or the steel, thereby forming carburized case 23. The coated, machined and carburized coupling is then austemper heat-treated, to increase the core body 18 hardness to above about 25 HRC and the inner thread 14 hardness to more than the core 18 hardness, or above about 30 HRC, whereby the thread roots 16 are greatly strengthened by hardened case 23, thereby enhancing the fatigue life of the coupling 10. The case hardening 23 is thicker than about 0.003 inches, and is generally less than about 0.05 inches, and is preferably from about 0.004 inches to about 0.03 inches.

This invention may be employed with any suitable steel or steel alloy coupling, providing that it may be carburized and subsequently austemper heat-treated. Representative steels that may be employed include AISI 1040, AISI 4130, AISI 4140 and AISI 8630.

In a sucker rod coupling subjected to cyclic loading, it is advantageous to have the threads harder than the core simply because this induces compressive stresses in the thread roots. These stresses make fatigue fracture much more difficult to initiate, resulting in a coupling with higher fatigue resistance, as compared to those found in conventional couplings with cut threads. In sucker rod couplings, this is usually accomplished by roll-forming the threads. This process, however, is limited to the softer grades of steel because costs of roll-forming greatly increase with harder materials. This is due to at least two factors: more power is required to turn the forming tool with harder grades of steel, and use of harder grades of steel results in decreased tool life, thereby requiring an increase in the number of tools necessary for manufacturing. If the coupling is heat treated to a high degree of hardness, the process becomes uneconomical. This is why Hermanson et al. provides for partially machine cutting the threads, and finishing only the last few thousandths of an inch by roll-forming.

Another method of increasing strength is by case hardening. This includes processes such as carburizing, carbonitriting, nitriting, flame hardening and induction hardening. These methods, however, usually are not used for conventional case hardening threaded areas of machined parts because these methods cause substantial dimensional distortion. These processes are thus limited to applications in which dimensional distortion is acceptable or is correctable by post machining.

A coating is applied to the coupling, preferably prior to carburization and austemper heattreatment. It is preferred that the coating is a corrosion resistant metallic coating, such as a coating made from one or more of the elements carbon, iron, nickel, chromium, molybdenum, cobalt, tungsten, silicon, boron and aluminum. For most applications, a nickel-based alloy is preferred. This may be applied by any means known in the art, including by thermospraying, fusing, diffusing, electroplating, vapor deposition or welding. In an alternative embodiment, the coating may be a non-metallic coating, such as a ceramic material.

In the method of this invention, the carburizing process allows diffusion of carbon into the subsurface of the threads 14 and thread roots 16, thus causing an increase in the carbon content, and forming carburized case 23. At the same time, the corrosion and wear resistant coating surface 12 acts as a barrier to carburization, and thus does not permit an increase in the carbon content on the outer surface. This is advantageous because if the corrosion resistant and wear coating 12 is worn off or abraded, an increase in carbon content of the underlying steel would increase susceptibility to corrosion cracking on exposure to corrosive fluids or excessive areas of the coupling. The coupling 10 is then hardened by austemper heat treatment, resulting in threads 14 and thread roots 16 that are harder than the core 18 because of the higher carbon content in the threads, thereby resulting in higher tensile strength in the thread roots and increased fatigue life of the coupling.

The carburization and austemper heat treatment steps make it possible to coordinate all other metallurgical and manufacturing steps, thereby producing an economical corrosion resistant, high strength coupling with high core strength and high fatigue resistant threads. Specifically, unlike other heat treatment methods, austemper heat treatment can be employed with a metallized corrosion resistant coating, without damage to the coating, and can further result in advantageous and specific changes to the thread and thread roots.

The heat treatment of carbon or alloy steels includes elevating the temperature to above its critical transformation point (AC1), which converts the microstructure of the metal to austenite. This structure is basically a face-center cubic structure and is stable only above this critical temperature (AC1) of the steel. Austenitic transformation in a simple iron-carbon metal usually starts to occur at the eutectoid temperature of approximately 1341° F. and is the temperature at which the metallurgical structure changes from ferrite and pearlite to austenite. Below this temperature, the metallurgical structure will transform back to soft ferrite, a body-centered structure, and pearlite, which is composed of ferrite and iron carbide. If cooling is rapid enough, however, to below a certain temperature called the martensite start (MS), the structure will transform to a body-centered tetragonal structure called martensite. This structure is much stronger and harder than either the austenite or ferrite/pearlite structures, but it is also very strained and brittle. Rapid cooling can usually be done in air, oil, water or brine, depending on the chemical composition of the alloy. Transformation to martensite usually occurs between 200° F. and 800° F., depending on the chemical composition of the alloy. Transformation to martensite causes high dimensional changes and subsequently much distortion in machined components. If however, the rapid cooling is interrupted, so that rapid cooling below the MS temperature does not occur, then the microstructure does not transform to martensite, but to bainite, a fine aggregate of ferrite and carbide with very little dimensional distortion.

Austempering is a heat treatment process in which a steel article is heated above its austenitizing temperature, usually about 1341° F., where the steel microstructure is transformed to austenite, as previously described, and subsequently quenched into a salt bath maintained at a temperature above the MS formation temperature, but below the pearlite formation temperature of the particular steel alloy being heat treated. This step allows the steel structure to isothermally transform to a microstructure called bainite, an extremely fine aggregate of ferrite and carbide. This bainite microstructure is very hard, almost as hard as martensite, but is much more ductile and fatigue resistant than is martensite at the same hardness levels. Bainite is also more dimensionally stable than martensite, allowing heat treatment of machined components while maintaining critical dimensions.

During the austempering process, the microstructure of the coupling core interior 18 undergoes a transformation from austenite to essentially bainite, because the coupling is quenched in a salt bath held at a temperature above the MS temperature of the steel alloy used. The MS temperature is primarily determined by the carbon content of the steel alloy, where a higher carbon content lowers the MS temperature, and a lower carbon content increases the MS temperature. In the embodiment in which a coupling is made of AISI 4130 low alloy steel, the MS temperature is about 710° F. If a higher carbon alloy is used, such as for example AISI 4140, then the MS temperature is decreased for example to about 640° F. Parts made of these alloys must be quenched and maintained above the MS temperature for longer than about less than about two (2) minutes in order to transform to bainite. If quenched below the MS temperature, or if the quenching temperature is not maintained above the MS temperature for longer than about two (2) minutes, then the microstructure will transform to essentially all martensite, a harder, more dimensionally unstable microstructure, causing the metallized corrosion resistant coating to crack and the threads to unacceptably distort.

The austempering process makes it possible for the coupling 10 to be heat treated after the coating 12 has been applied on the outer surface. If a coupling is heat treated in a conventional manner, the coating 12 will crack and chip, making the coupling 10 useless for service. This occurs because of the very drastic thermo-shock produced between the steel and the nickel base coating. Austempering is a more gradual quenching process and greatly minimizes the impact of thermo-expansion differences between unlike materials and greatly reduces the likelihood for coating cracking and thread distortion.

After cooling to room temperature, the core 18 hardness will be about 25 HRC or greater and the case 23 and threads 14 about 30 HRC or greater because of the higher carbon content of the case 23 and threads 14. Because of the higher carbon content of the case 23, including threads 14 forming a part thereof, the hardness of case 23 will, as a result of the austempering process, be at least equal to and generally higher than that of core 18. As the coupling is austempered, the core 18 microstructure transforms to essentially fine bainite and the case 23 microstructure transforms to a mixture of essentially martensite and bainite, whereby this difference induces compressive stresses in the thread roots 16. This combination also makes the threads 14 more fatigue resistant.

Austempering also allows more dimensional stability of the coupling 10 in general and the threads 14 in particular. By processing the finished coupling in this manner, it allows the manufacture of a product with high core strength, high fatigue resistance and high corrosion and wear resistance at a much reduced cost than is currently available.

It should be noted that the process described above may be performed so that some of the steps are combined or performed simultaneously. For example, the coupling 10 may be carburized and austempered simultaneously; cooled and tempered or; carburized, cooled, reheated to austemper and cooled and finally tempered and cooled; or any other combination where threading is completed before any of these steps. It is also possible to temper the coupling after austempering, but in general tempering is not required.

INDUSTRIAL APPLICABILITY

The invention is further illustrated by the following non-limiting example.

EXAMPLE 1

The methods of this invention may be employed for the simultaneous carburizing and austempering heat treatment process of a finished machined coupling made with a steel alloy, such as AISI 4130 or 8630, which has been coated with a wear and corrosion resistant alloy to produce a superior high strength coupling.

A steel coupling 10 made of AISI 8630 alloy coated with a corrosion and wear resistant nickel-based chrome and boron containing alloy 12 was threaded as appropriate, and was loaded into a furnace where it was austenitized and carburized at 1,600° F. for about one hour at a carbon potential of about 0.60%. Carburizing the coupling 10 caused carbon to diffuse into the threaded portion 14 of the coupling, thereby increasing the carbon content and forming case 23. The outer surface was not carburized because the corrosion and wear resistant alloy coating 12 acted as a barrier to carbon diffusion. The carburizing media can be gaseous, liquid or solid, provided that the carbon potential is above the original alloy carbon content. The coupling 10 was quenched into a salt bath maintained at a temperature of 700° F. for at least two minutes and subsequently cooled to room temperature, allowing selective case hardening to occur in the case 23m including threaded 14 portion of the coupling. The austenitizing and high temperature quenching, or austempering, was conducted such that the steel alloy was quenched in a media held above the MS temperature of the specific steel alloy being heat treated. As the coupling was quenched from the austenitizing temperature and into the salt bath and held for two minutes or longer and then cooled to room temperature, the core 18, with its lower carbon content, was transformed to essentially all bainite, which has a tough and strong microstructure.

Although metallurgical transformation of the case 23 during the high temperature quench was retarded by holding the coupling in the salt bath above the MS temperature of the core, subsequent cooling below the MS temperature of the case 23 transformed the case 23 microstructure to essentially all martensite and bainite until the coupling temperature eventually reached room temperature. With AISI 8630 alloy the MS temperature of the core is about 700° F., but the MS temperature of the carburized case 23, with its higher carbon content, of about approximately 0.60%, is about 480° F. The case 23 is then transformed to a mixture of martensite and bainite, a harder and stronger microstructure, upon cooling to below 480° F. The higher strength of the case occurs when the martensite that develops occupies a greater volume than its original austenitic volume and consequently is put in compression, a well known fatigue-enhancing metallurgical mechanism. Further, by selective carburizing and ausquenching the coupling, the case 23 that develops is much deeper, greater than 0.003 inch, as compared to the Harmensen et. al. method in which the case depth is only about 0.003 inch after cold rolling by mechanical means.

Since case hardening does not take place in the outer surface and overall coupling microstructure is almost all bainite, it does not change the dimensions appreciably, and thus dimensional changes in the coupling are minimized. The coating 12 integrity is also maintained because the high temperature ausquench does not expand or contract the coating alloy enough to cause cracking.

The simultaneous and selective carburizing and austempering process of this invention thus allows very different and specific transformation of the core and case which develop very different metallurgical properties, that is, resulting in hardening the case 23 and threads 14 thereby achieving higher fatigue endurance, maintaining dimensional stability, and strengthening and toughening the core 18, while not disturbing the coating 12 and maintaining integrity of the coating 12.

The preceding example and described method can be repeated with similar success by substituting the generically or specifically described constituents, steel alloys, coatings, temperatures, carburizing procedures, austempering procedures, quenching media, and/or operating conditions of this invention for those used in the preceding example and described method.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of making a corrosion resistant threaded steel coupling with high fatigue strength, comprising the steps of:

providing a cylindrical steel coupling of defined wall thickness having an inner surface and an outer surface;

coating the outer surface with a corrosion and wear resistant metallic coating;

threading the inner surface to finished dimension with a plurality of threads;

carburizing the cylindrical steel coupling, whereby the carbon content of the threaded inner surface is increased; and heat treating the cylindrical steel coupling by austempering, whereby the hardness of the threaded inner surface is increased.

2. The method of claim 1, whereby after heat treating the interior of the wall thickness of the cylindrical steel coupling has a microstructure comprising primarily bainite, and the threaded inner surface has a microstructure comprising primarily a mixture of martensite and bainite.

3. The method of claim 1, wherein the interior of the wall thickness of the cylindrical steel coupling has a Rockwell hardness of at least about 25 HRC and the threaded inner surface has a Rockwell hardness of at least about 30 HRC.

4. The method of claim 3, wherein the interior of the wall thickness of the cylindrical steel coupling has a Rockwell hardness of at least about 30 HRC and the threaded inner surface has a Rockwell hardness of at least about 33 HRC.

5. The method of claim 1, wherein the steel comprises carbon and iron.

6. The method of claim 5, wherein the steel further comprises at least one element selected from the group consisting of manganese, nickel, chromium, molybdenum, silicon and boron.

7. The method of claim 1, wherein the corrosion resistant metallic coating comprises at least one element selected from the group consisting of carbon, iron, nickel, chromium, molybdenum, cobalt, tungsten, silicon, boron and aluminum.

8. The method of claim 1, wherein the coating comprises at least one application technique selected from the group consisting of thermospraying, fusing, diffusing, electroplating, vapor deposition and welding.

9. The method of claim 1, wherein the carburizing comprises heating above about 1400° F. for at least about thirty minutes in an atmosphere with a carbon potential of at least about 0.35%.

10. The method of claim 9, wherein the carbon potential is at least about 0.60%.

11. The method of claim 1, wherein heat treating by austempering comprises heating to an austenitic transformation temperature for at least about thirty minutes, rapidly cooling into a salt bath maintained at a temperature above the martensite start temperature but below the pearlite formation temperature, maintaining in the salt bath for at least about two minutes, and cooling to room temperature.

12. The method of claim 11, wherein the heat treating by austempering comprises maintaining in the salt bath for at least about four minutes.

13. The method of claim 11, wherein the heat treating by austempering further comprises reheating to a temperature of at least about 200° F. for at least about five minutes to temper the microstructure following cooling to room temperature.

* * * * *